US009302865B2

(12) United States Patent
Omori

(10) Patent No.: US 9,302,865 B2
(45) Date of Patent: Apr. 5, 2016

(54) SHEET FEEDING APPARATUS AND IMAGE FORMING APPARATUS

(71) Applicant: CANON KABUSHIKI KAISHA, Tokyo (JP)

(72) Inventor: Akira Omori, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/932,574

(22) Filed: Jul. 1, 2013

(65) Prior Publication Data

US 2014/0008863 A1 Jan. 9, 2014

(30) Foreign Application Priority Data

Jul. 4, 2012 (JP) ..... 2012-150467

(51) Int. Cl.
*B65H 3/56* (2006.01)
*B65H 3/06* (2006.01)
*B65H 7/00* (2006.01)

(52) U.S. Cl.
CPC ..... *B65H 3/06* (2013.01); *B65H 3/0669* (2013.01); *B65H 3/0684* (2013.01); *B65H 3/56* (2013.01); *B65H 7/00* (2013.01); *B65H 2403/512* (2013.01); *B65H 2405/1134* (2013.01); *B65H 2405/1136* (2013.01); *B65H 2511/12* (2013.01); *B65H 2511/22* (2013.01); *B65H 2515/34* (2013.01); *B65H 2515/81* (2013.01)

(58) Field of Classification Search
CPC ..... B65H 3/5223; B65H 2401/231; B65H 2515/81; B65H 3/52; B65H 2405/1136; B65H 2405/1134; B65H 3/56; B65H 3/5253
USPC ..... 271/121, 124, 167
See application file for complete search history.

(56) References Cited

U.S. PATENT DOCUMENTS

| | | | | |
|---|---|---|---|---|
| 6,880,821 | B2 * | 4/2005 | Park | 271/121 |
| 7,455,288 | B2 * | 11/2008 | Ruhe et al. | 271/124 |
| 7,852,526 | B2 * | 12/2010 | Mo et al. | 358/498 |
| 8,141,866 | B2 * | 3/2012 | Okawa et al. | 271/121 |
| 8,517,375 | B2 * | 8/2013 | Otani et al. | 271/167 |
| 2011/0127713 | A1 * | 6/2011 | Emoto et al. | 271/147 |
| 2011/0180986 | A1 * | 7/2011 | Okawa et al. | 271/127 |

FOREIGN PATENT DOCUMENTS

JP 10-72142 A 3/1998

* cited by examiner

*Primary Examiner* — Luis A Gonzalez
(74) *Attorney, Agent, or Firm* — Canon USA, Inc. I.P. Division

(57) ABSTRACT

A sheet feeding apparatus includes a sheet stacking portion on which sheets are stacked, a sheet feeding unit configured to feed the sheets stacked on the sheet stacking portion, a slope portion arranged downstream of the sheets in a feeding direction of the sheets stacked on the sheet stacking portion and configured to separate the sheets from each other, the sheets fed by the sheet feeding unit being bent when contacting the slope portion, and a contact width variable mechanism configured to change a contact width in which the slope portion and a leading edge of the sheet, in the feeding direction, fed by the sheet feeding unit are in contact with each other by moving part of the slope portion in the feeding direction or in a direction opposite to the feeding direction.

9 Claims, 12 Drawing Sheets

SHEET FEEDING APPARATUS AND IMAGE FORMING APPARATUS

BACKGROUND OF THE INVENTION

1. Field of the Invention

Aspects of the present invention generally relate to a printer, a sheet feeding apparatus, and an image forming apparatus equipped with the sheet feeding apparatus.

2. Description of the Related Art

Conventionally, an image forming apparatus such as a printer or a copying machine is equipped with a sheet feeding apparatus for feeding a sheet to an image forming unit.

Such a sheet feeding apparatus is provided with a separation mechanism for separating and feeding sheets one by one.

Japanese Patent Application Laid-Open No. 10-72142 discusses a sheet feeding apparatus equipped, as a separation mechanism, with a feeding roller configured to feed the uppermost sheet of sheets stacked on a feeding tray, and a separation slope with which the sheet fed by the feeding roller comes into contact. In the sheet feeding apparatus discussed in Japanese Patent Application Laid-Open No. 10-72142, sheets are fed by the feeding roller, and solely the uppermost sheet is bent to move over the separation slope, whereby the uppermost sheet is separated from the second sheet and subsequent sheets.

However, in the sheet feeding apparatus discussed in Japanese Patent Application Laid-Open No. 10-72142, the width of the separation slope that can contact the sheet (i.e., the area of the separation slope with the sheet thickness included) is constant, so that the apparatus leaves room for improvement in terms of separating and feeding of various kinds of sheets.

In the following, the above sheet feeding apparatus will be described in detail.

In the separation mechanism for separating sheets from each other by using the separation slope and the feeding roller, it is necessary to bent the uppermost sheet of sheets stacked on the feeding tray to thereby separate the uppermost sheet from the sheet directly under the uppermost sheet.

For the sheet to move over the separation slope, it is necessary to apply, to the sheet, a larger force than the force for maintaining a sheet plane with the rigidity of the sheet, i.e., a larger force than the force required for bending the sheet to move over the separation slope (hereinafter referred to as a bending force). The separation mechanism configured to separate sheets from each other by using the separation slope and the feeding roller, the sheet being fed by the feeding roller is bent by coming into contact with the separation slope and receiving a reaction force from the separation slope.

An examination by the present inventor has made it clear that, when the sheet is bent by the reaction force from the separation slope, the sheet is bent more easily when the reaction force per unit area received from the separation slope (hereinafter referred to as a face pressure) is larger than the bending force of the sheet.

Here, the bending force of the sheet varies depending on the grammage, rigidity, etc., of the sheet. For example, in the case of a sheet having high grammage and rigidity (thick paper sheet or the like), the bending force becomes large, whereas, in the case of a sheet having low grammage and rigidity (thin paper sheet or the like), the bending force becomes small.

On the other hand, the reaction force the sheet being in contact with the separation slope receives from the separation slope varies depending on the conveyance force by the feeding roller. However, if the conveyance force by the feeding roller is constant, the face pressure the sheet receives from the separation slope varies depending on the contact width (area) in which the sheet is in contact with the separation slope. More specifically, when the width in which the separation slope and the sheet are in contact with each other is set to be large, the face pressure becomes low, whereas, when the width in which the separation slope is in contact with the sheet is set to be small, the face pressure becomes high.

Thus, by setting the width in which the separation slope is in contact with the sheet to be small to increase the face pressure, the sheet is easily bent when the sheet having a large bending force is fed. Here, due to the friction force between the uppermost sheet and the sheet directly under the uppermost sheet, there is exerted a moving force in the feeding direction between the uppermost sheet and the sheet directly below the uppermost sheet (i.e., the second sheet). Thus, if the face pressure is increased, in the case where a sheet having a small bending force is fed, the second sheet may be simultaneously fed due to the frictional force. This may results in double feeding with two sheets being fed in an overlapped state.

On the other hand, if the width in which the separation slope and the sheet are in contact with each other is set to be large to diminish the face pressure, even when the sheet having a small bending force is fed, the above-mentioned double feeding is made unlikely to occur. However, if the face pressure is diminished, the reaction force (face pressure) the sheet receives from the separation slope becomes rather small when a sheet having a large bending force is fed, so that, in some cases, the sheet cannot be bent to be separated and fed.

As described above, in the sheet feeding apparatus discussed in Japanese Patent Application Laid-Open No. 10-72142, the width in which the separation slope is in contact with the sheet is constant, so that, if the kind of sheet (the grammage, rigidity, etc., of sheet) is changed, double feeding may occur, and thus, in some cases, sheets cannot be separated and fed.

SUMMARY OF THE INVENTION

According to an aspect of the present invention, a sheet feeding apparatus includes a sheet stacking portion on which sheets are stacked, a sheet feeding unit configured to feed the sheets stacked on the sheet stacking portion, a slope portion arranged downstream of the sheets in a feeding direction of the sheets stacked on the sheet stacking portion and configured to separate the sheets from each other, the sheets fed by the sheet feeding unit being bent when contacting the slope portion, and a contact width variable mechanism configured to change a contact width in which the slope portion and a leading edge of the sheet, in the feeding direction, fed by the sheet feeding unit are in contact with each other by moving part of the slope portion in the feeding direction or in a direction opposite to the feeding direction.

Further features of the present invention will become apparent from the following description of exemplary embodiments with reference to the attached drawings.

DESCRIPTION OF THE EMBODIMENTS

Figure 12:
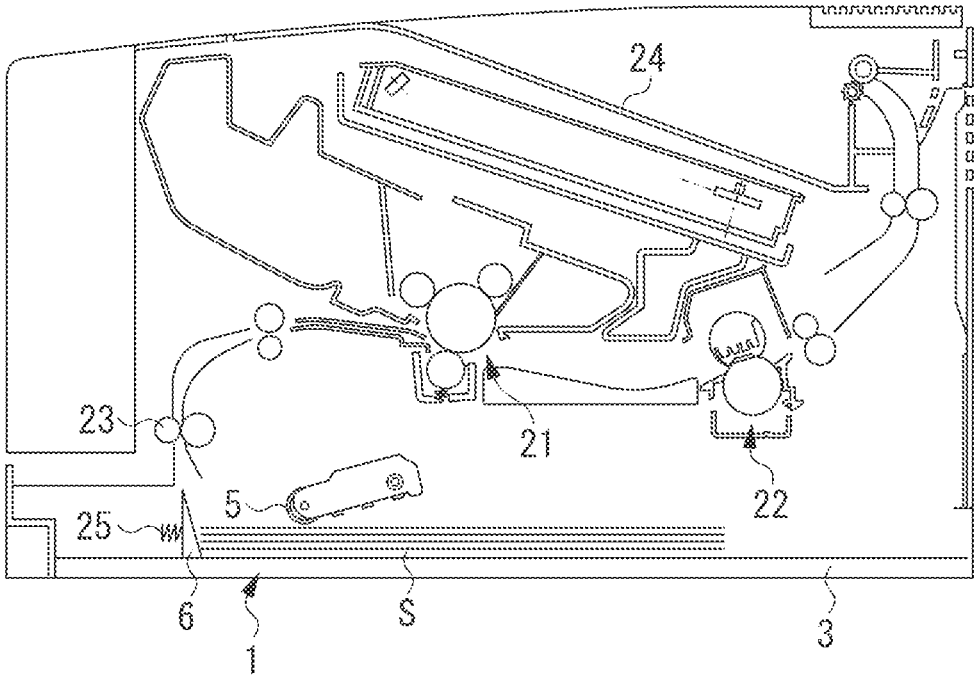
FIG. 12 is a schematic diagram illustrating an image forming apparatus to which the first exemplary embodiment is applied.

First, the overall construction of an image forming apparatus 100 to which the sheet feeding apparatus according to a first exemplary embodiment is attached will be described with reference to FIG. 12. A sheet feeding apparatus 1 situated in the lower portion of the image forming apparatus 100 is equipped with a sheet feeding tray 3 as a sheet stacking portion on which sheets are stacked.

The bundle of sheets S stacked on the sheet feeding tray 3 is conveyed downstream in the feeding direction by a feeding roller 5 as a sheet feeding unit for feeding sheets. The sheets fed by the feeding roller 5 are separated from each other and fed by a slope portion 50 including a first contact member 6 as a first contact portion and a second contact member 7 as a second contact portion, and are sent to a sheet conveyance path in the image forming apparatus main body (hereinafter referred to as the apparatus main body).

On the downstream side of the sheet feeding apparatus 1 in the sheet conveyance path in the apparatus main body, there is provided a conveyance roller 23 as a conveyance unit 23, and the sheets fed by the sheet feeding apparatus 1 are conveyed to a transfer unit 21 by the conveyance roller 23. At the transfer unit 21, a developed toner image is transferred to a sheet, and the sheet is conveyed to a fixing unit 22. At the fixing unit 22, heat and pressure are applied to the sheet to which the toner image has been transferred, and the toner image is fixed to the sheet. The sheet to which the toner image has been fixed is discharged onto a discharge tray 24.

Next, the sheet feeding apparatus 1 to which the first exemplary embodiment is applied will be described in detail.

Figure 1:
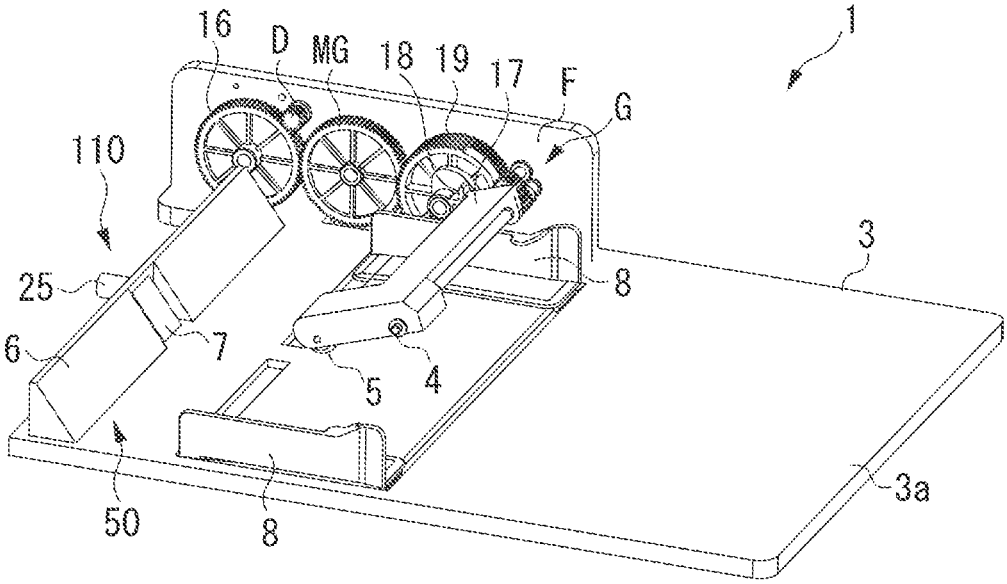
FIG. 1 is a perspective view of a sheet feeding apparatus according to a first exemplary embodiment.

FIG. 1 is a perspective view of the sheet feeding apparatus 1 according to the first exemplary embodiment. On the sheet feeding tray 3 on which sheets are stacked, there are provided a pair of width regulation portions 8 for regulating the position of a sheet in a width direction, which is a direction orthogonal to the sheet feeding direction. The sheet feeding tray 3 is fixed to the apparatus main body, and a sheet placement surface 3*a* on which sheets are placed is arranged in a substantially horizontal manner.

The feeding roller 5 arranged above the sheet feeding tray 3 is retained by a retaining portion 17 which is placed so as to be vertically swingable around a swinging shaft 4 provided on an apparatus main body frame F. With the retaining portion 17, the feeding roller 5 is vertically movable around the swinging shaft 4.

On the frame F, there is arranged a drive transmission mechanism 200 configured to transmit the drive from a motor M serving as a drive source. As illustrated in FIG. 2, the drive transmission mechanism 200 is equipped with a retaining portion driving gear 19 configured to swing the retaining portion 17 through the rotation of an elevation cam 18, and an intermediate gear 16. Further, the drive transmission mechanism 200 is equipped with an intermediate gear MG arranged between the retaining portion driving gear 19 and the intermediate gear 16, and a drive transmission gear D configured to transmit the drive from the motor M to the intermediate gear 16.

The feeding roller 5 is rotated through the transmission of the drive force by the motor M from the retaining portion driving gear 19 via a driving gear row G. Through swinging of the retaining portion 17, the feeding roller 5 swings downwards to come into contact with the upper surface of the bundle of sheets stacked on the sheet feeding tray 3, and the feeding roller 5 is rotated via the driving gear row G, whereby the uppermost sheet is fed. A part of the tooth surface of the retaining portion driving gear 19 meshing with the driving gear row G is cut out to form a cutout portion 19*a*. When the cutout portion 19*a* faces the driving gear row G, no drive is transmitted to the feeding roller 5, so that the rotation of the feeding roller 5 is temporarily stopped.

Figure 2A:
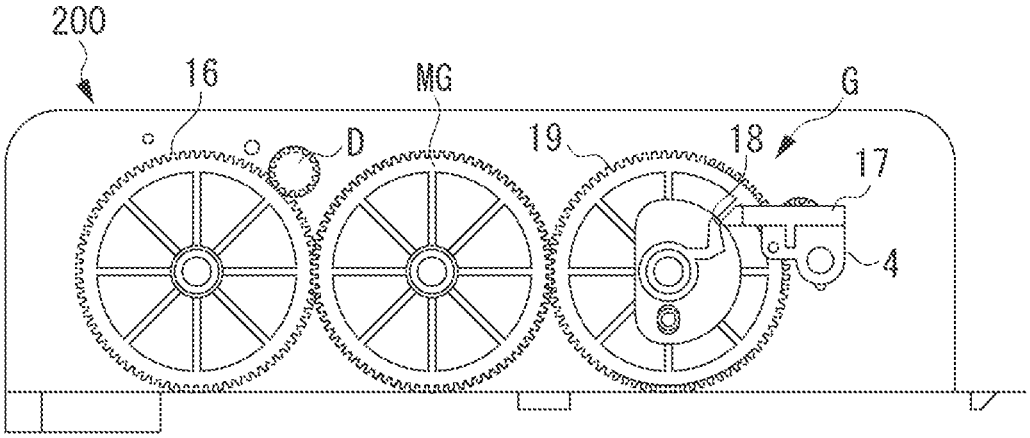
FIGS. 2A and 2B are front view of a drive transmission mechanism according to the first exemplary embodiment.

As illustrated in FIG. 2A, the retaining portion 17 is configured to vertically swing through the rotation of the elevation cam 18 being in sliding contact with an end portion of the retaining portion 17. The elevation cam is fixed to the retaining portion driving gear 19 meshing with the driving gear row G. The drive force from the motor M is transmitted to the retaining portion driving gear 19 via the driving gear row G, whereby the retaining portion driving gear 19 is rotated. Through the rotation of the retaining portion driving gear 19, the elevation cam 18 rotates to vertically swing the retaining portion 17, and the feeding roller 5 moves vertically.

Figure 2B:
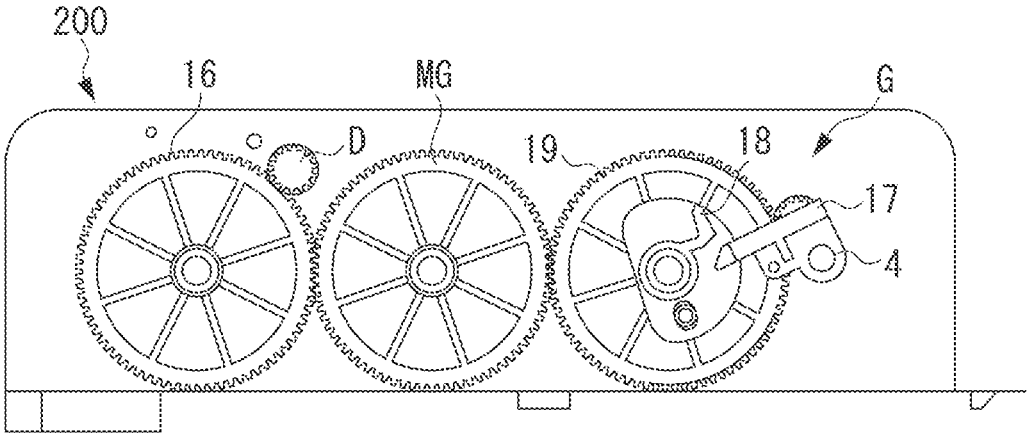

FIG. 2B illustrates how the sliding relationship between the elevation cam 18 and the retaining portion 17 is released to cause the feeding roller 5 to descend to come into contact with the upper surface of the bundle of sheets (the uppermost sheet) stacked on the sheet feeding tray 3. When the retaining portion 17 is detached from the elevation cam 18, the feeding roller 5 descends due to its own weight or by an urging unit such as a spring (not illustrated).

On the downstream side, in the sheet feeding direction (the left-hand side in FIG. 1), of the feeding roller 5, there is provided a slope portion 50. The slope portion 50 includes a first contact member 6 configured to come into contact with the sheet fed by the feeding roller 5, and a second contact member 7 whose contact surface is provided downstream of the first contact member 6 in the sheet feeding direction. As illustrated in FIG. 1, the surfaces of the first contact member 6 and the second contact member 7 that come into contact with the sheet are inclined toward the downstream side with respect to the sheet feeding direction. That is, the surfaces of the first contact member 6 and the second contact member 7 coming into contact with the sheet are inclined so as to be raised as the surfaces extend from upstream toward downstream. A contact with variable mechanism 110 is equipped with a spring 25 serving as an urging member configured to urge the first contact member 6 in a direction opposite to the feeding direction. Further, the first contact member 6 is placed so as to be movable in the feeding direction and in the direction opposite to the feeding direction, whereas the second contact member 7 is provided integrally with the sheet placement surface 3*a*. Thus, the first contact member 6 is provided so as to be capable of sliding toward the downstream side in the feeding direction against the urging force of the spring 25 when the first contact member 6 is pressed by the sheet being conveyed by the feeding roller 5. The contact width (the width in the direction orthogonal to the sheet feeding direction) with which the leading edge, in the feeding direction, of the uppermost sheet fed by the feeding roller 5 is in contact will be described in detail below.

Further, the sheet feeding apparatus 1 according to the first exemplary embodiment is equipped with the contact width variable mechanism 110 configured to change the contact width with which the leading edge, in the feeding direction, of the uppermost sheet being fed by the feeding roller is in contact, by moving the first contact member 6 constituting part of the slope portion 50 in the feeding direction.

The force by which the sheet being fed by the feeding roller 5 presses the first contact member 6 varies depending on the grammage, rigidity, etc., of the sheet being fed. When the grammage, rigidity, etc., are high, the force by which the sheet presses the first contact member 6 is large. The urging force by the spring 25 is set as appropriate according to the characteristics of the apparatus. When the values of the grammage, rigidity, etc., of the sheet are smaller than predetermined values, the sheet cannot move the first contact member 6 against the urging force of the spring 25.

Next, the operation of separating and feeding the sheet by the sheet feeding apparatus 1 according to the first exemplary embodiment will be described with reference to FIGS. 3 and 4. First, the operation of separating and feeding a sheet whose grammage, rigidity, etc., are low and whose bending force is small, will be described with reference to FIG. 3. The bending force means a force required for bending the sheet.

Figure 3A:
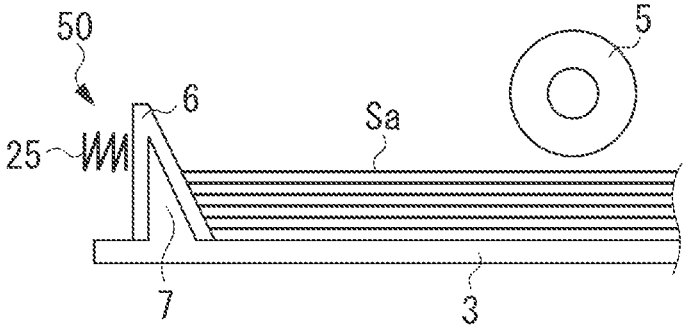
FIGS. 3A, 3B, and 3C are diagrams illustrating a sheet feeding operation according to the first exemplary embodiment.

FIG. 3A is a schematic diagram illustrating the state in which a user has set a bundle of sheets S having a small bending force on the feeding tray 3. The portion of the sheet near the leading edge on the downstream side in the feeding direction is in a substantially horizontal state, and is in contact with the first contact member 6. In this state, the feeding roller 5 is situated at the upper, retracted position, and the second contact member 7 integral with the sheet stacking portion 3 is situated downstream, in the conveyance direction, of the first contact member 6, so that the bundle of sheets does not come into contact with the second contact member 7.

Figure 3B:
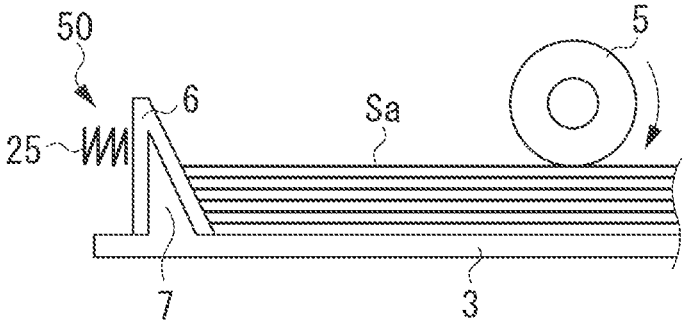
Figure 3C:
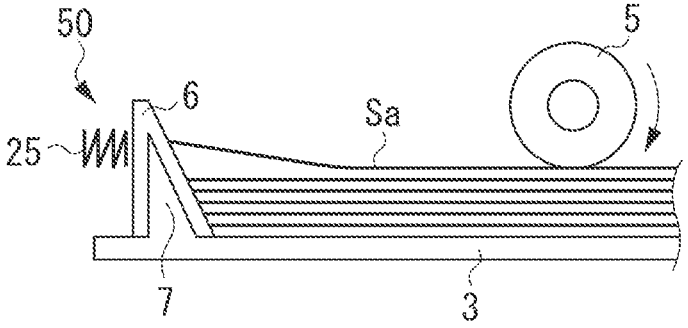

As illustrated in FIG. 3B, when the sheet feeding operation is started, the feeding roller 5 swings downwards from the upper, retracted position, and comes into contact with the uppermost sheet Sa of the bundle of sheets S stacked on the sheet feeding tray 3 to rotate thereon (The drive transmission mechanism 200 undergoes transition from the state illustrated in FIG. 2A to the state illustrated in FIG. 2B). As a result, the uppermost sheet Sa is fed, and the leading edge of the uppermost sheet Sa moved over by the first contact member 6 as illustrated in FIG. 3C is separated from the second sheet and subsequent sheets.

At this time, the coefficient of friction between the feeding roller 5 and the sheet is set such that the feeding force by the feeding roller 5 is larger than the bending force required for bending the uppermost sheet (the force for maintaining the planar configuration by the rigidity of the sheet). Also, the second sheet and subsequent sheets S is tried to be fed toward downstream in the feeding direction by the frictional force between the sheets. However, this frictional force is smaller than the bending force of the sheet, so that the second sheet and subsequent sheets are not bent.

Next, the operation of separating and feeding a sheet whose grammage, rigidity, etc., are high and whose bending force is large will be described with reference to FIGS. 4A through 4C. Regarding the feeding operation similar to that in the case of a sheet having a small bending force, a description thereof will be left out as appropriate.

Figure 4A:
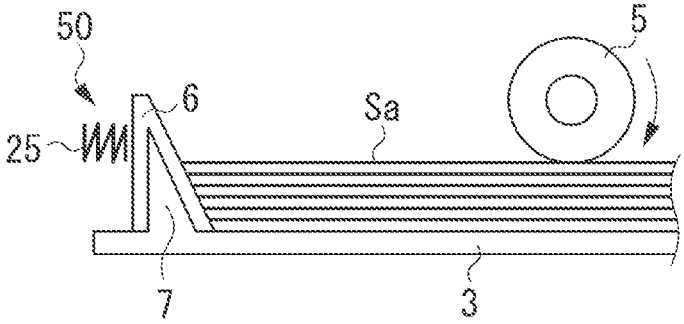
FIGS. 4A, 4B, and 4C are diagrams illustrating the sheet feeding operation according to the first exemplary embodiment.

FIG. 4A is a diagram illustrating how a bundle of sheets having a large bending force such as thick paper sheets or envelopes are stacked on the sheet feeding tray 3. In this state, when the sheet feeding operation is started, the feeding roller 5 descends to come into contact with the uppermost sheet Sa, and the feeding roller 5 starts to rotate to convey the uppermost sheet Sa downstream.

Figure 4B:
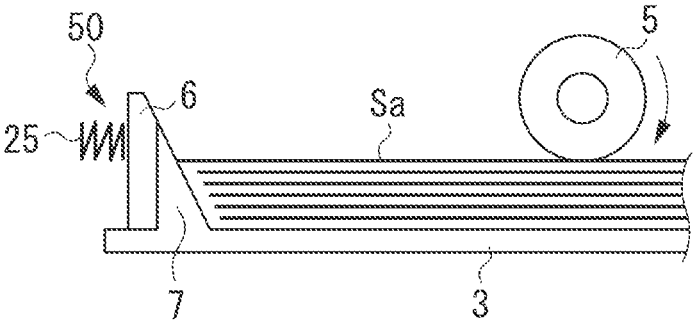

When the first contact member 6 of the slope portion 50 is pressed by the sheet Sa being conveyed by the feeding roller 5, the first contact member 6 of the slope portion 50 compresses the spring 25, and moves downstream as illustrated in FIG. 4B. This is due to the fact that the bending force of the sheet is larger than the force for urging the first contact member 6 by the spring 25.

The first contact member 6 pressed by the sheet moves until the leading edge of the uppermost sheet Sa comes into contact with the upstream-side contact surface 7*b* of the second contact member 7. As illustrated in FIG. 1, the second contact member 7 is arranged at a position where the central portion of the first contact member 6 is cut out.

In this way, the second contact member 7 is provided in the vicinity of the center in the feeding direction, so that even when the size of the sheet being fed is a small, the sheet conveyed with reference to the center can come into contact with the second contact member 7.

The width where the second contact member 7 comes into contact with the sheet (the width in the direction orthogonal to the sheet feeding direction) is smaller than that of the first contact member 6. Accordingly, the leading edge of the uppermost sheet Sa receives the reaction force from the second contact member 7 in a smaller range than that of the first contact member 6. That is, the reaction force (face pressure) per unit area applied to the sheet from the slope portion 50 becomes larger, so that even in the case of a sheet having a large bending force, the sheet can be bent as illustrated in FIG. 4B.

Figure 4C:
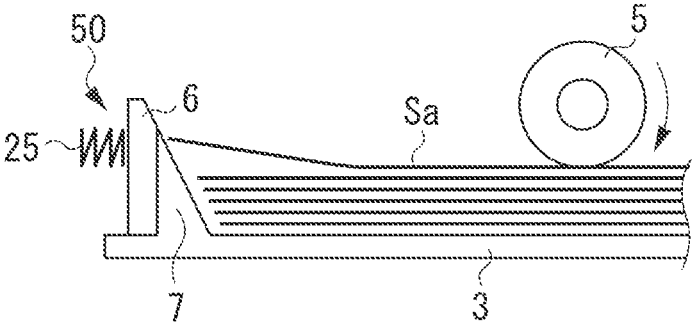

The operation illustrated in FIG. 4C, which illustrates the feeding operation after the bending of the sheet, is similar to the feeding operation for the sheet having a small bending force described above, so a description thereof will be left out.

Figure 5A:
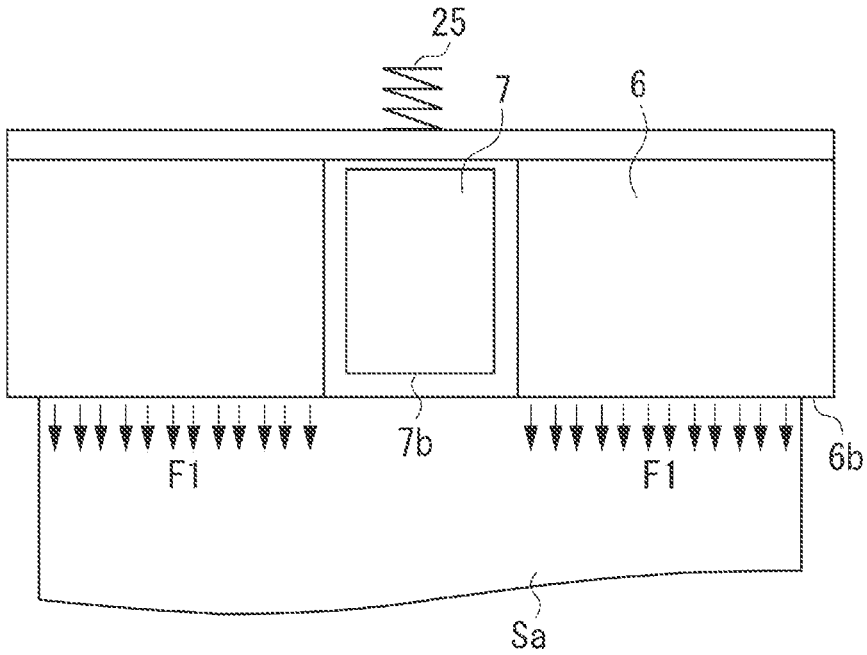
FIGS. 5A and 5B are schematic sectional views illustrating a slope portion, as seen from above according to the first exemplary embodiment.
Figure 5B:
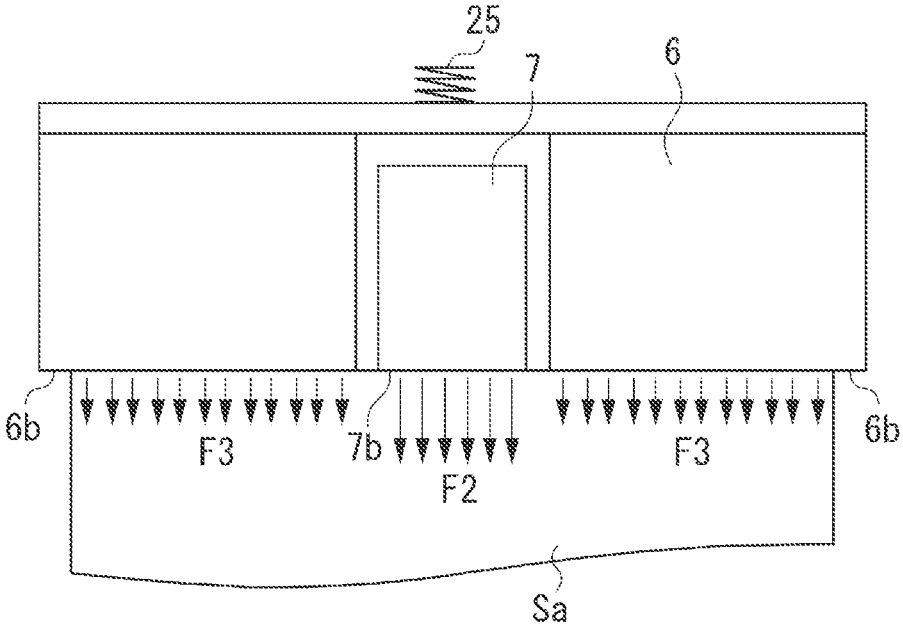

Next, the reason why even a sheet having a large bending force can come into contact with the second contact member 7 will be described with reference to FIGS. 5A and 5B. FIGS. 5A and 5B are schematic sectional views, as seen from above, of the first contact member 6 and the second contact member 7, illustrating how the face pressure the uppermost sheet Sa receives varies. When the sheet feeding operation is started, and the uppermost sheet Sa is conveyed downstream by the feeding roller 5, the uppermost sheet Sa comes into contact with the contact surface 6*b* of the first contact member 6 as illustrated in FIG. 5A, and receives a reaction force F1 (face pressure) solely from the first contact member 6. As illustrated in FIG. 3B, in the case of a sheet having relatively low grammage and rigidity, the bending force is small, so that the sheet is bent solely by the reaction force F1 (face pressure) from the first contact member 6.

However, in the case of a sheet having relatively high grammage and rigidity, the bending force is large, so that the sheet is not bent by the reaction force F1 from the first contact member 6 alone. A sheet having a large bending force causes the first contact member 6 to move against the force of the spring 25. Then, as illustrated in FIG. 5B, the uppermost sheet Sa comes into contact with the contact surface 7*b* of the second contact member 7.

As described above, the contact width in which the uppermost sheet Sa comes into contact with the second contact member 7 is smaller than the contact width in which the uppermost sheet Sa comes into contact with the first contact member 6. The uppermost sheet receiving a reaction force (face pressure) F2 from the contact surface 7*b* of the second contact member 7 simultaneously receives a reaction force (face pressure) F3 from the contact surface 6*b* of the first contact member 6. However, the reaction force F2 received from the contact surface 7*b* in a small range is larger than the reaction force F3 received from the first contact member 6 in a large range, so that the uppermost sheet Sa is easily bent.

The reaction force F3 the sheet receives from the first contact member 6 in the state illustrated in FIG. 5B is larger, by the amount of the reaction force compressing the spring 25, than the reaction force F1 the sheet receives from the first contact member 6 in the state illustrated in FIG. 5A.

In the sheet feeding apparatus 1 according to the first exemplary embodiment described above, a sheet having a small bending force such as a plain paper sheet whose grammage and rigidity are low is bent by receiving a weak reaction force from the first contact member 6 having the large contact width. When a sheet having a large bending force such as an envelope whose grammage and rigidity are high, which cannot be bent by the reaction force received from the first contact member 6, is fed, the first contact member 6 is pushed by that sheet and moves downstream in the feeding direction. The sheet having the large bending force is bent by coming into contact with the second contact member 7 having the small contact width and receiving a strong reaction force from the second contact member 7. Thus, in the first exemplary embodiment, it is possible to reliably separate and feed various kinds of sheets ranging from a sheet having a small bending force to a sheet having a large bending force.

Next, a second exemplary embodiment will be described.

Figure 6:
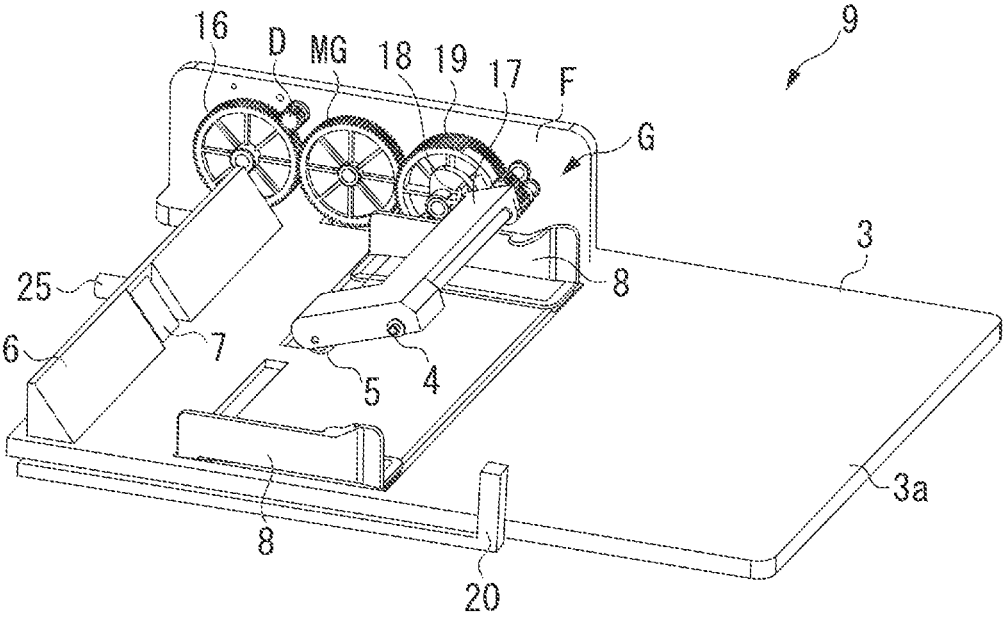
FIG. 6 is a perspective view of a sheet feeding apparatus according to a second exemplary embodiment.

FIG. 6 is a perspective view of a sheet feeding apparatus 9 according to the second exemplary embodiment. The second exemplary embodiment differs from the first exemplary embodiment in that the user can move the first contact member 6 in the feeding direction by operating a lever 20 as an operating portion. Otherwise, the construction and operation are substantially similar to those in the first exemplary embodiment, so a description thereof will be left out as appropriate.

Figure 7A:
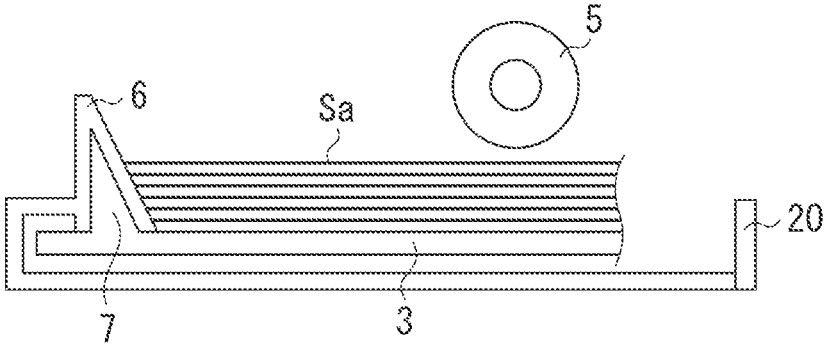
FIGS. 7A and 7B are diagrams illustrating a sheet feeding operation according to the second exemplary embodiment.

As illustrated in FIG. 7A, when the user sets the lever 20 at a first position, the first contact member 6 is situated on the upstream side, in the feeding direction, of the second contact member 7, and the sheet conveyed by the feeding roller 5 comes into contact with the first contact member 6. Since the first contact member 6 is fixedly connected with the lever 20, the first contact member 6 is regulated so as not to move downstream in the feeding direction.

Figure 7B:
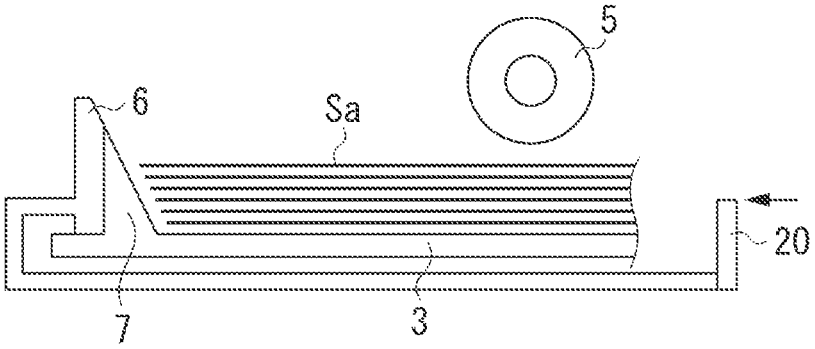

As illustrated in FIG. 7B, when the user sets the lever 20 at a second position, the first contact member 6, which is fixedly connected with the lever 20, moves downstream in the feeding direction. As a result, the sheet conveyed by the feeding roller 5 can come into contact with the second contact member 6.

The sheet feeding operation, etc., are similar to those in the first exemplary embodiment, so a description thereof will be left out.

As described above, according to the second exemplary embodiment, the user moves the lever 20 as the contact width variable mechanism between the first position and the second position, whereby the first contact member 6 can be moved in the feeding direction. For example, when the sheet to be fed is a sheet having a small bending force, the user can move the lever 20 to the first position, and when the sheet to be fed is a sheet having a large bending force, the user can move the lever 20 to the second position.

Although, in the second exemplary embodiment described above, the first contact member 6 having a large contact width is moved in the feeding direction by the lever 20, it is also possible to move the second contact member 7 having a small contact width in a direction opposite to the feeding direction.

Next, a third exemplary embodiment will be described.

Figure 8A:
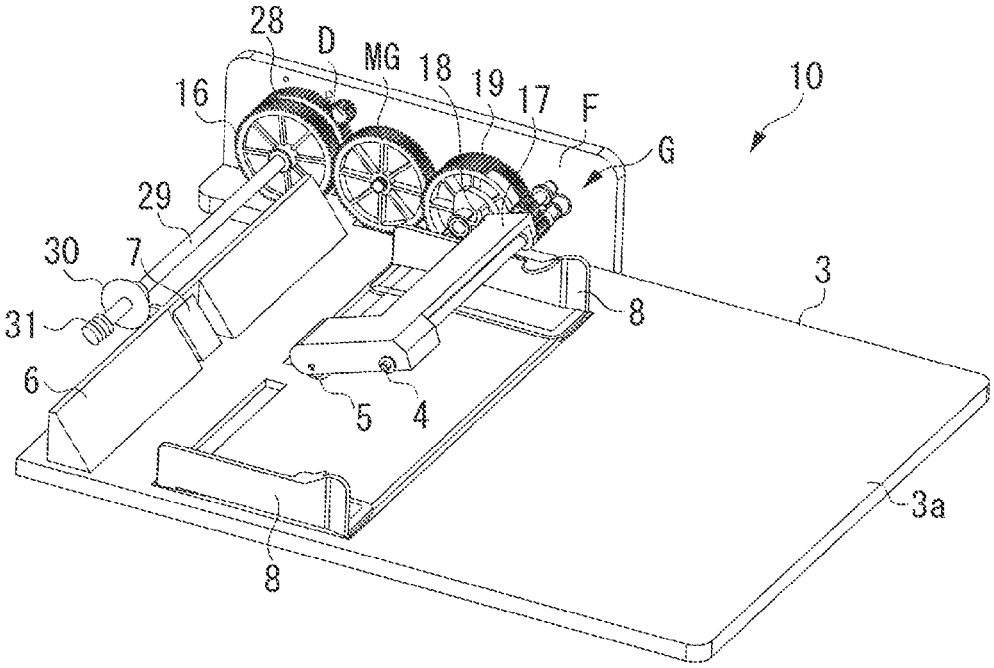
FIGS. 8A and 8B are perspective views of a sheet feeding apparatus according to a third exemplary embodiment.
Figure 8B:
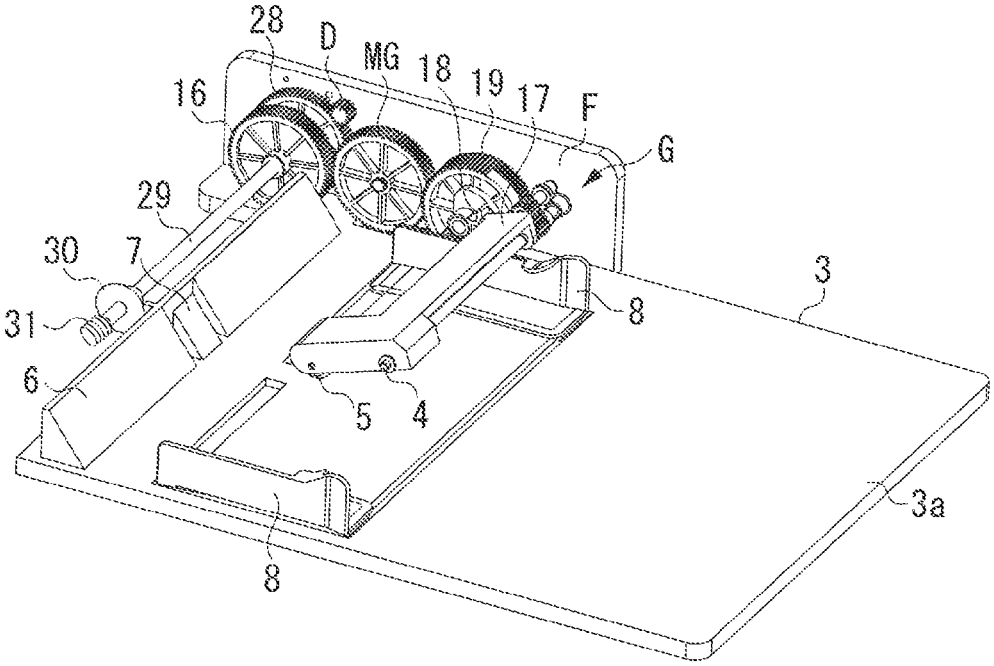

FIGS. 8A and 8B are perspective views of a sheet feeding apparatus 10 according to the third exemplary embodiment. According to the third exemplary embodiment, the first contact member 6 is moved according to the magnitude of the rotational load (hereinafter referred to as the feeding load torque) of the feeding roller 5 varying depending on the rigidity of the sheet. That is, the third exemplary embodiment differs from the first exemplary embodiment in that the first contact member 6 is moved in the feeding direction by a feeding load torque. Otherwise, the construction and operation are substantially similar to those in the first exemplary embodiment, so a description thereof will be left out as appropriate.

Figure 9A:
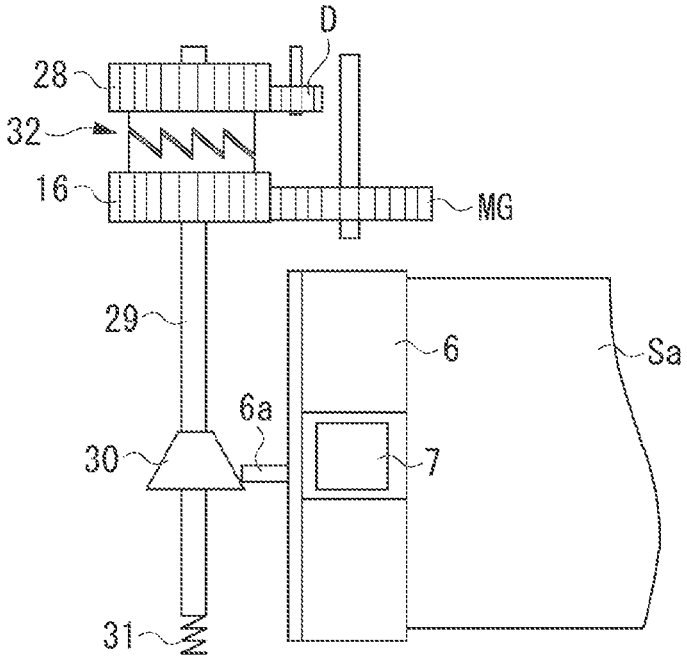
FIGS. 9A and 9B are diagrams illustrating a sheet feeding operation according to the third exemplary embodiment.
Figure 9B:
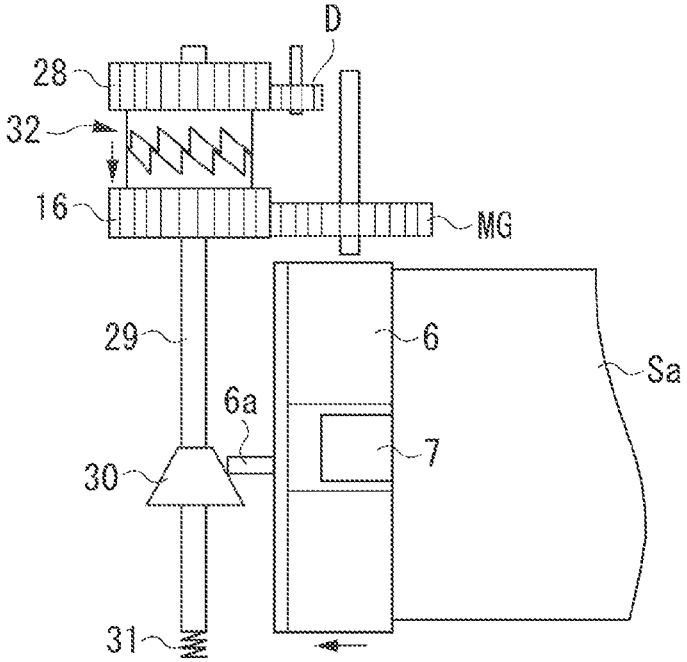
Figure 10:
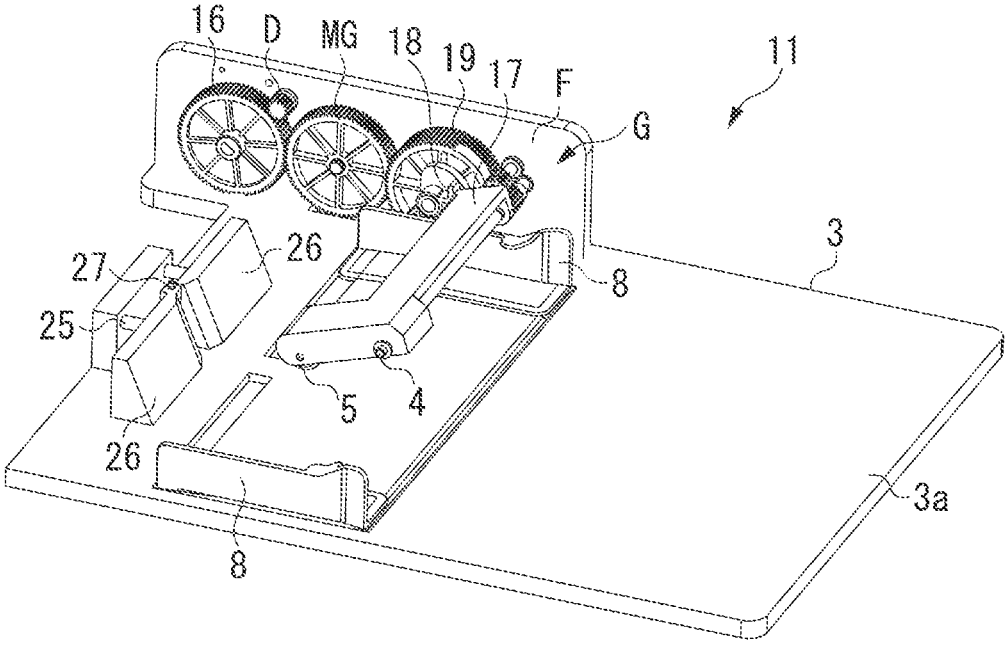
FIG. 10 is a perspective view of a sheet feeding apparatus according to a fourth exemplary embodiment.

In FIG. 9, a drive gear 28 is rotated by the drive transmitted from the drive transmission gear D, and a ratchet mechanism 32 illustrated in FIG. 10 is provided between the drive gear 28 and the intermediate gear 16. A gear shaft 29 fixed to the intermediate gear 16 is urged toward the drive gear 28 by an urging spring 31. A rib 6*a* is formed on the first contact member 6, and a regulation member 30 is provided on the gear shaft 29. This regulation member 30 has a tapered configuration.

The feeding load torque occurred when the sheet is fed is transmitted to the intermediate gear 16 via an intermediate gear MG. As illustrated in FIGS. 8A and 9A, when the feeding load torque is small, the intermediate gear 16 rotates while meshing with the drive gear 28.

As illustrated in FIGS. 8B and 9B, when the feeding load torque is large, the intermediate gear 16 moves away from the drive gear 28 against the urging force of the urging spring 31. As a result, the regulation member 30 fixed to the gear shaft 29 also moves in the direction of the arrow in FIG. 9B. The first contact member 6 is urged in the feeding direction by an urging unit (not illustrated), so that the rib 6*a* of the first contact member 6 comes into contact with the side surface of the regulation member 30 having a smaller outer diameter. In this way, when the feeding load torque is large, the first contact member 6 moves toward the downstream side in the feeding direction, so that the sheet being fed can come into contact with the second contact member 7.

Thus, according to the third exemplary embodiment, when a sheet having low grammage such as a thin paper sheet is fed, the feeding load torque is small. Thus, the sheet can be bent and separated by allowing the sheet to come into contact with the first contact member 6. On the other hand, when a sheet having high grammage such as a thick paper sheet is fed, the feeding load torque is large. Thus, the first contact member 6 moves toward the downstream side in the feeding direction. As a result, the sheet having high grammage such as a thick paper sheet can be bent and separated by allowing the sheet to contact the second contact member 7.

According to the third exemplary embodiment, even when the conveyance force by the feeding roller varies depending upon the sheet stacking amount, it is always possible to move the first contact member 6 with a fixed load on the feeding roller (sheet feeding torque) and to allow the sheet to come into contact with the second contact member 7. Thus, independently of the sheet stacking amount, i.e., independently of whether it is a small amount or a full amount, the width of the slope with which the sheet being fed comes into contact can be changed, thereby separating and feeding the sheet in a stable manner.

Next, a fourth exemplary embodiment will be described.

FIG. 10 is a perspective view of a sheet feeding apparatus 10 according to the fourth exemplary embodiment. The fourth exemplary embodiment differs from the first exemplary embodiment in the construction and operation of the first contact portion and the second contact portion of the slope portion. Otherwise, the construction and operation are substantially similar to those in the first exemplary embodiment, so a description thereof will be left out as appropriate.

As illustrated in FIG. 10, a slope portion 150 according to the fourth exemplary embodiment is equipped with a movable slope 26 configured to swing around a swinging shaft 27, and the sheet fed by the feeding roller 5 is bent by coming into contact with the movable slope 26.

Figure 11A:
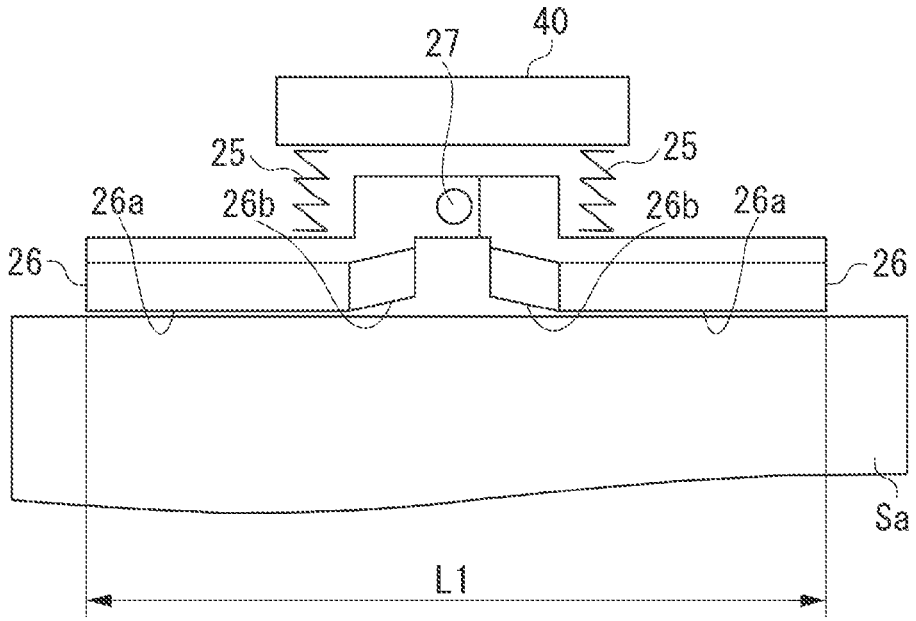
FIGS. 11A and 11B are schematic sectional views illustrating a slope portion, as seen from above according to the fourth exemplary embodiment.
Figure 11B:
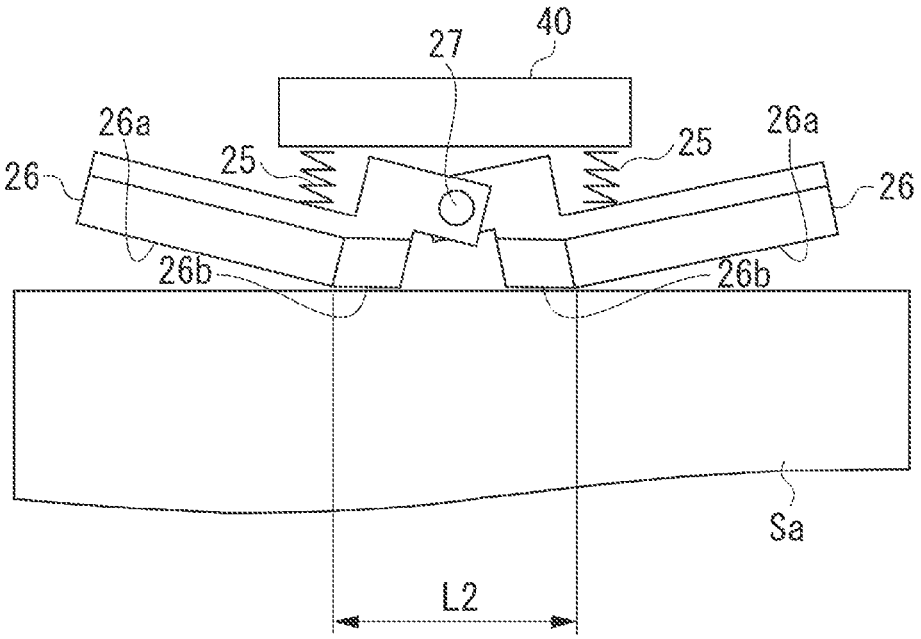

FIGS. 11A and 11B are schematic views, as seen from above, of a movable wall 29 of the slope portion 150. As illustrated in FIGS. 11A and 11B, the movable slope 26 is urged in a direction opposite to the feeding direction by an urging spring 26 arranged between the movable slope 26 and a stationary wall 40. The movable slope 26 can be swung by being pushed by the sheet fed by the feeding roller 5. The movable slope 26 configured to swing by being pushed by the sheet swings solely in the feeding direction, and does not swing in the direction of the thickness of the sheet stacked thereon (not swing in the vertical direction).

In the fourth exemplary embodiment, the movable slope 26 includes a first contact surface 26*a* as the first contact portion and a second contact surface 26*b* as the second contact portion, with the first contact portion and the second contact portion being formed by a single member (i.e., integrally). Further, the contact width of the second contact surface 26*b* is smaller than the contact width of the first contact surface 26*a*. Thus, the reaction force (face pressure) the sheet fed by the feeding roller 5 receives from the second contact surface 26*b* is larger than the reaction force (face pressure) the sheet receives from the first contact surface 26*a*.

As illustrated in FIG. 11A, when a sheet having a small bending force is fed, the sheet Sa fed by the feeding roller 5 is bent by coming into contact with the first contact surface 26*a* as the first contact portion of the movable wall 26.

On the other hand, when a sheet having a large bending force is fed, the sheet Sa fed by the feeding roller 5 is not bent even when the sheet Sa comes into contact with the first contact surface 26*a* of the movable slope 26. As illustrated in FIG. 11B, the movable slope 26 is swung by being pushed by the sheet Sa fed by the feeding roller 5 and coming into contact with the first contact surface 26*a*. The sheet having a large bending force is bent by coming into contact with the second contact surface 26*b*.

The feeding operation, etc., after the bending of the sheet are similar to those of the first exemplary embodiment, so a description thereof will be left out.

As described above, according to the fourth exemplary embodiment, the movable slope 26 does not swing in the vertical direction but solely swings in the feeding direction, so that the conveyance force required for the swing of the movable slope 26 is not changed depending on the sheet stacking amount. Thus, independently of the amount of sheets stacked on the sheet feeding tray 3, i.e., independently of whether it is a small amount or a full amount, the movable slope 26 can be swung with a fixed conveyance force, thus bending, separating, and feeding the sheet in a stable manner. Further, according to the fourth exemplary embodiment, when the sheet comes into contact with the second contact surface 29*b*, the sheet does not come into contact with the first contact surface 29*a*, so that the sheet can receive a reaction force solely from the second contact surface 29*b*. Thus, it is possible to diminish the conveyance force when the sheet is brought into contact with the second contact surface 29*b* to be bent.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-150467 filed Jul. 4, 2012, which is hereby incorporated by reference herein in its entirety.

What is claimed is:

1. A sheet feeding apparatus comprising:

a sheet stacking portion on which sheets are stacked;

a sheet feeding unit configured to feed the sheet in a sheet feeding direction stacked on the sheet stacking portion; and a slope portion arranged downstream of the sheet stacking portion in a feeding direction of the sheet, the sheet fed by the sheet feeding unit being bent when contacting the slope portion, the slope portion comprises a first contact portion to which the sheet fed by the sheet feeding unit contacts and a second contact portion arranged downstream of the first contact portion in the feeding direction of the sheet and to which the sheet fed by the sheet feeding unit contacts, and an operation member movable between a first position and a second position, configured to be directly operated by user and which is directly fixed to the first contact portion, wherein in a case where user positions the operation member at the first position, a leading edge of the sheet fed by the feeding unit contacts the first contact portion and does not contact the second contact portion, and in a case where user positions the operation member at the second position, a leading edge of the sheet fed by the feeding unit contacts the second contact portion.

2. The sheet feeding apparatus according to claim 1, wherein a contact width in which the second contact portion contacts the sheet is smaller than a contact width in which the first contact portion contacts the sheet.

3. The sheet feeding apparatus according to claim 1, wherein, in a case where a basis weight of the sheet being fed is less than a predetermined value, the sheet fed by the sheet feeding unit is bent by contacting the first contact portion.

4. The sheet feeding apparatus according to claim 3, wherein in a case where a basis weight of the sheet being fed is larger than or equal to the predetermined value, the sheet fed by the sheet feeding unit is bent by contacting the second contact portion.

5. An image forming apparatus comprising:

a sheet feeding apparatus according to claim 1; and an image forming unit configured to form an image on a sheet fed by the sheet feeding apparatus.

6. The sheet feeding apparatus according to claim 1, wherein in a case where the sheet feeding unit feeds a plurality of sheets at a time, the slope portion separates the plurality of sheets from each other.

7. The sheet feeding apparatus according to claim 1, wherein the slope portion slopes so that a downstream side of the slope portion in the feeding direction of the sheet is higher than an upstream side of the slope portion in the feeding direction of the sheet.

8. A sheet feeding apparatus comprising:

a sheet stacking portion on which sheets are stacked;

a sheet feeding unit configured to feed the sheets stacked on the sheet stacking portion;

a slope portion arranged downstream of the sheets in a feeding direction of the sheets stacked on the sheet stacking portion and configured to separate the sheets from each other, the sheets fed by the sheet feeding unit being bent when contacting the slope portion; and a contact width variable mechanism configured to change a contact width in which the slope portion and a leading edge of the sheets, in the feeding direction, fed by the sheet feeding unit are in contact with each other by moving part of the slope portion in the feeding direction or in a direction opposite to the feeding direction, wherein the sheet feeding unit includes a feeding roller configured to feed the sheet, wherein a magnitude of a rotational load of the feeding roller causes the contact width variable mechanism to move part of the slope portion.

9. The sheet feeding apparatus according to claim 1, wherein the sheet feeding unit includes a feeding roller configured to feed the sheet, and a mechanism configured to move the feeding roller between a position where the feeding roller is in contact with sheets stacked on the sheet stacking portion and a position where the feeding roller is upwardly retracted from the sheets.

* * * * *